US006624555B2

(12) United States Patent
Hell et al.

(10) Patent No.: US 6,624,555 B2
(45) Date of Patent: Sep. 23, 2003

(54) DIRECTLY HEATED THERMIONIC FLAT EMITTER

(75) Inventors: Erich Hell, Erlangen (DE); Detlef Mattern, Erlangen (DE); Markus Schild, Herzogenaurach (DE)

(73) Assignee: Siemens Aktiengesellschaft, Munich (DE)

( * ) Notice: Subject to any disclaimer, the term of this patent is extended or adjusted under 35 U.S.C. 154(b) by 120 days.

(21) Appl. No.: 09/876,949

(22) Filed: Jun. 11, 2001

(65) Prior Publication Data

US 2001/0052743 A1 Dec. 20, 2001

(30) Foreign Application Priority Data

Jun. 14, 2000 (DE) ..... 100 29 253

(51) Int. Cl.[7] ..... H01J 35/06; H01J 19/08; H01J 19/06

(52) U.S. Cl. ..... 313/329; 313/341; 313/310; 313/346 R; 313/346 DC

(58) Field of Search ..... 313/310, 341, 313/342, 343, 337, 629, 346 R, 346 DC, 329

(56) References Cited

U.S. PATENT DOCUMENTS 2,919,373 A * 12/1959 Riley et al. ..... 313/341

FOREIGN PATENT DOCUMENTS

| | | |
|---|---|---|
| DE | 336781 | 5/1921 |
| DE | 486 245 | 11/1929 |
| DE | 27 27 907 | 1/1979 |
| DE | 100 16 125 | 11/2000 |

OTHER PUBLICATIONS

U.S. patent application No. 09/557,769, filed Apr. 25, 2000.

* cited by examiner

*Primary Examiner*—Nimeshkumar D. Patel
*Assistant Examiner*—Sharlene Leurig
(74) *Attorney, Agent, or Firm*—Young & Thompson

(57) ABSTRACT

A directly thermionic flat emitter is presented whose emitting surface contains meandering conductor tracks. The conductor tracks are formed by slots in the emitting surface. The slots are arranged as claimed in a pattern of cuts which comprises a multiplicity of straight slots (3; 8, 9) which run at least transverse to the course of the main current direction and are arranged in a plurality of rows offset from one another. Meandering current paths (4) are thereby produced.

11 Claims, 3 Drawing Sheets

DIRECTLY HEATED THERMIONIC FLAT EMITTER

BACKGROUND OF THE INVENTION

The invention relates to a directly heated thermionic flat emitter whose emitting surface has conductor tracks which are formed by slots in the emitting surface and are supported by emitter legs which form current conductors, the conductor tracks being formed by a grid-like pattern of cuts composed of a multiplicity of straight slots which run at least transverse to the course of the main current direction and are arranged in a plurality of rows offset from one another.

DESCRIPTION OF THE RELATED ART

Thermionic flat emitters such as are described, for example, in DE 100 16 125 A1, which is not a prior publication, are used in X-ray tubes, in particular in rotary piston X-ray tubes. The part of the emitter forming the emitting surface is generally of disk-shaped design and comprises a thin, slotted tungsten sheet with a thickness of approximately 100 to 200 $\mu$m. The current is conducted via emitter legs which are situated diametrically opposite one another and adjoin the emitting surface.

In order to achieve electron emission in the X-ray tube, the emitting surface has to be heated up to above 2000° C. At these high temperatures, the stability of tungsten is already diminished as safe. In addition, "creeping effects" which have a negative effect on the shaping of the emitter occur owing to the high centrifugal forces, which are produced by the selfrotation of the rotary piston X-ray tube, and also by mounting stresses. This influence also particularly has a disadvantages effect on the shape of the focal spot or on the configuration of the focal spot. Geometrical changes in the emitter during the lifetime of the tube therefore have to be recallibrated by altered external magnetic fields to the extent this is at all possible.

In the design of a thermionic flat emitter for use in a rotary piston tube, it is therefore necessary to take into account that tungsten loses strength at high temperatures, in particular above 2000° C., and to take care that temperature changes as small as possible occur over the mostly circular emitting surface, and that there is as high a mechanical strength as possible in order to keep the mechanical distortion of the emitter as low as possible given the high temperatures and the loads from the centrifugal forces.

DE 27 27 907 A1 discloses a directly heated thermionic flat emitter of the type mentioned at the beginning, whose emitting surface has meandering conductor tracks which run transverse to the main current direction and are formed by slots in the emitting surface and are supported by emitter legs which form current conductors, the conductor tracks being arranged in two rows and forming a single current path.

Moreover, DE-C 336 781 discloses a directly heated thermionic emitter whose emitting surface is supported by emitter legs, which form current conductors, and has conductor tracks which run transverse to the main current direction and are formed by slots in the emitting surface.

DE-C 486 245 discloses a luminous element for electric incandescent lamps, which is designed as a hollow body which is essentially of rotationally symmetric design and is provided with openings which allow blackbody radiation to emerge.

SUMMARY OF THE INVENTION

Although the emitter described in the patent application mentioned at the beginning offers good conduction of current with its spirally wound conductor tracks, and although this emitter design already achieves a longer service life than emitters of coiled design, the aim is to achieve further improvement under the above named points of view.

The invention specified below is therefore based on the object of improving an emitter of the generic type mentioned at the beginning to the effect that a higher mechanical stability, in particular a higher strength against distortion, is achieved, and that no destruction of the emitter can occur owing to ions being welded on, which would result in immediate failure of the X-ray tube.

It may be remarked with reference to the last named effect that during operation of an X-ray tube the interaction of the focused electrons with the tungsten anode produces a strong local temperature rise which can lead to fusing of the tungsten on the anode. The temperature rise at the anode leads, in turn, to gases being released from the anode and its surroundings which lead to a pressure rise in the tube. Moreover, tungsten vapour is also produced by the fusing process. If molecules of gas or vapour are now located in the region of high field strengths between the cathode and anode, said molecules are partially ionized and accelerated in the direction of the cathode. The course of the field lines gives rise to a focusing effect, which means that the ion beam impinges in a concentrated fashion on the emitter and has a very strong local heating effect on the tungsten sheet there. The tube current also rises sharply owing to this additional energy input. Local, partial instances of fusing with attendant "burning out" of the emitter can result in the case of a lengthy operating time, and thus a lengthy exposure time.

In the emitter according to the invention, the conductor tracks are formed by a grid-like pattern of cuts which comprises a multiplicity of straight slots which run at least transverse to the main current direction and are arranged in a plurality of rows offset from one another, a multiplicity of meandering current paths being formed thereby.

The particular advantages of such a design are that the strength of the current tracks against distortion is improved, that a virtually isotropic state with uniform current density in all directions is achieved, and that no destruction of the emitter can occur owing to ions being welded on. Moreover, such a design permits a closed outer contour, resulting in a further increase in mechanical stability. The design of the conductor tracks according to the invention finally also permits easier monitoring of the state of the emitter without demounting the tube, for example by identifying the state of the emitter by resistance measurement or detecting the welding-on of ions or by determining changes in focal spot, it thereby being possible to determine the residual lifetime of the tube.

In accordance with an advantageous design, the pattern of cuts forms a multiplicity of parallel, meandering current paths. Owing to the multiplicity of meandering turns, the cross-section and the length of the individual current tracks, and thus the electrical resistance of the individual meanders can be set such that the required current intensity is not higher overall, and can, rather, be kept lower than in the case of spirally running conductor tracks of known designs.

It is particularly advantageous when the individual cells of the rectangular structure of cuts have additional diagonal cuts. It is possible thereby to achieve an even more homogenous current distribution. As a rule, it is possible for the current to be conducted as usual by two emitter legs; the stability can be increased, however, when, as proposed in accordance with a further advantageous variant, four emitter legs are provided.

BRIEF DESCRIPTION OF THE DRAWINGS

A plurality of exemplary embodiments of the invention are explained in more detail with the aid of the drawing, in which.

DESCRIPTION OF THE PREFERRED EMBODIMENTS

Figure 1:
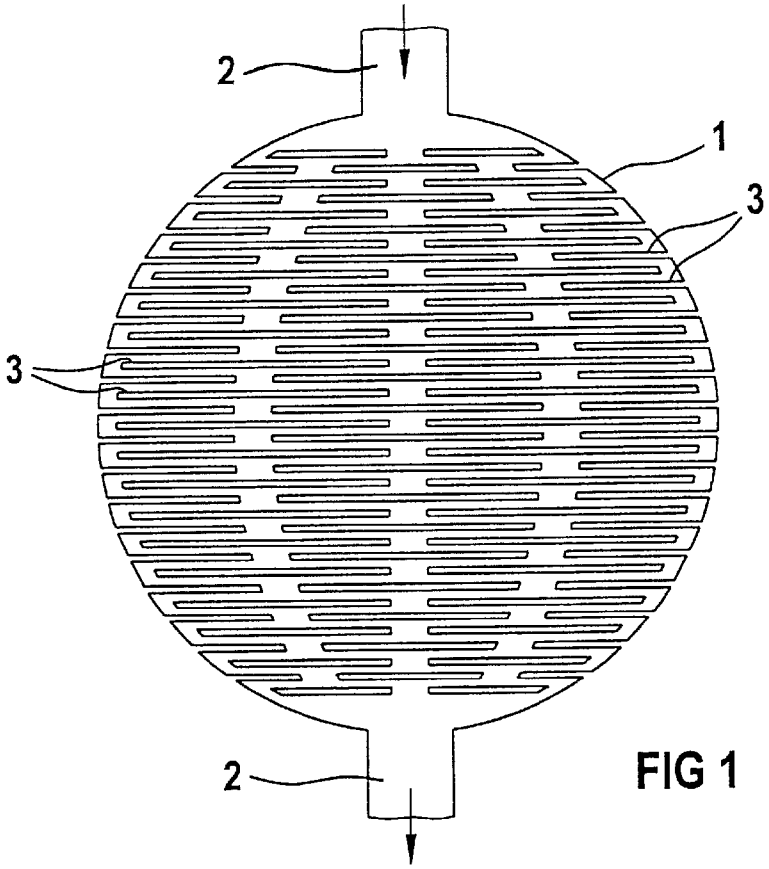
FIG. 1 shows a first design of a flat emitter according to the invention.

FIG. 1 shows, in a plan view and a greatly enlarged representation, a thermionic flat emitter with a circular emitting surface 1 which is adjoined by two emitter legs 2 which are situated diametrically opposite one another and are angled off perpendicular to the plane of the drawing in the finally mounted state. The emitter surface 1 has a multiplicity of slots 3, which are arranged transverse to the main current direction (indicated by arrows), and are arranged in a plurality of rows respectively offset from one another. The pattern of cuts thereby produced has a plurality of, in the present case four, parallel, meandering current paths 4 through which the current fed via the one emitter leg can branch.

Figure 2:
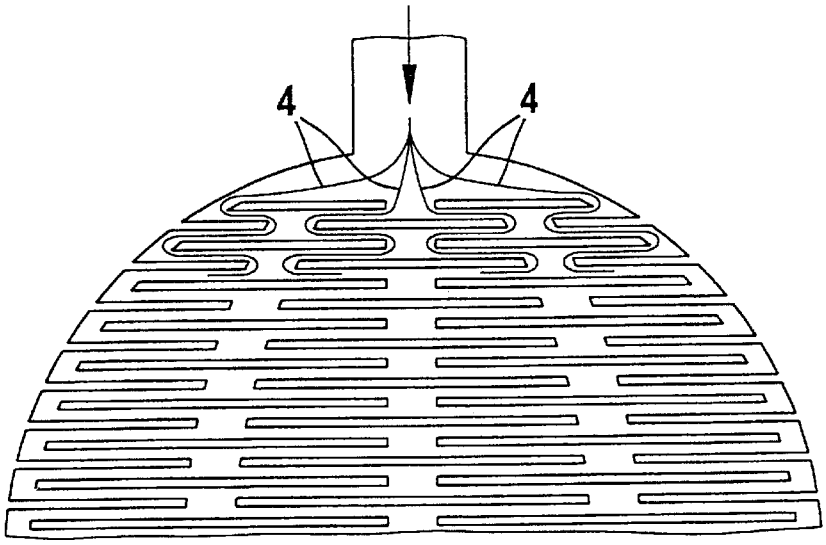
FIG. 2 shows a detail of the emitter according to FIG. 1, with the representation of the current paths.

FIG. 2 indicates the course of the current over the four current paths.

A particularly homogenous current distribution in conjunction with high mechanical stability is achieved with the arrangement shown. As an alternative to the previously described design, the conductor tracks can form a pattern of cuts both from slots running transverse to the main current direction and from slots running in the main current direction, as illustrated in the following figures.

Figure 3:
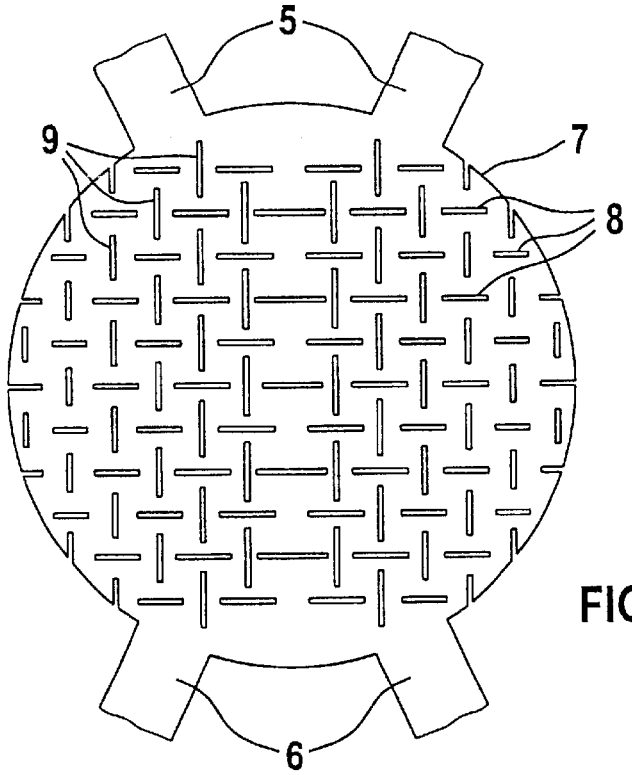
FIG. 3 shows an emitter with a rectangular pattern of cuts and a four-leg connection.

FIG. 3 shows a four-leg emitter design, that is to say two emitter legs 5 for feeding current and two emitter legs 6 for discharging current. The mechanical strength can be further increased with the aid of such a four-leg design. In this design, the emitter surface 7 has a grating-like grid structure which is produced by straight, very short slots 8, 9 which run both in and also transverse to the main current direction.

Figure 4:
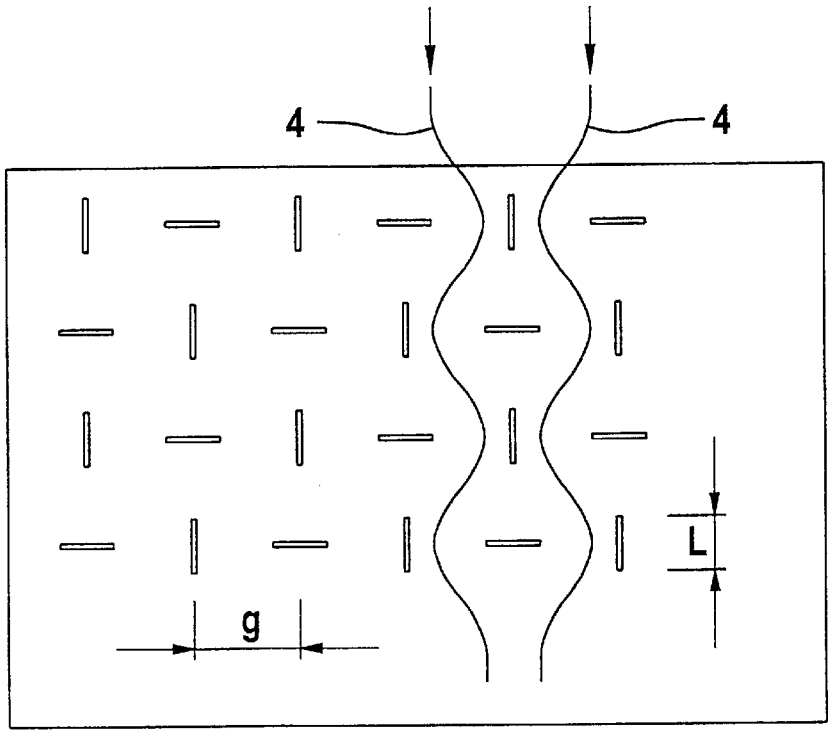
FIG. 4 shows a sketch of the principle of the pattern of cuts of the emitter according to FIG. 3.

The pattern of cuts according to which the slots are arranged, and the course of the current paths are explained with the aid of FIG. 4, it being assumed that the mean conductivity of the grid structure runs continuously in a relatively wide range. In order to achieve this state, only two parameters can be varied per se, specifically the grating constant (g), that is to say the center-to-center distance of a slot, and the ratio (n) of the half cut length to the grating constant (g). The width of cut, which has only a slight influence on the current distribution, should be kept as small as technically possible. The risk of short circuits is relatively low owing to the relatively short cuts and the high stability against distortion thereby achievable.

The grating constant (g) is advantageously selected between 0.1 mm and 1 mm for the entire surface. A mean grating constant of 0.4 mm has proved to be advantageous in the case of an assumed diameter of 5 mm for an emitting surface.

The ratio (n) of the half cut length (L) to the grating constant (g) can be configured to vary in a direction transverse to the main current direction, and can be between 0.8 at the center and 0.3 at the edge, for example. The conductivity can thereby be increased at the edge to compensate for the longer path, and be reduced in the center. The strength and the torsional rigidity on the outside at the edge are simultaneously increased.

Figure 5:
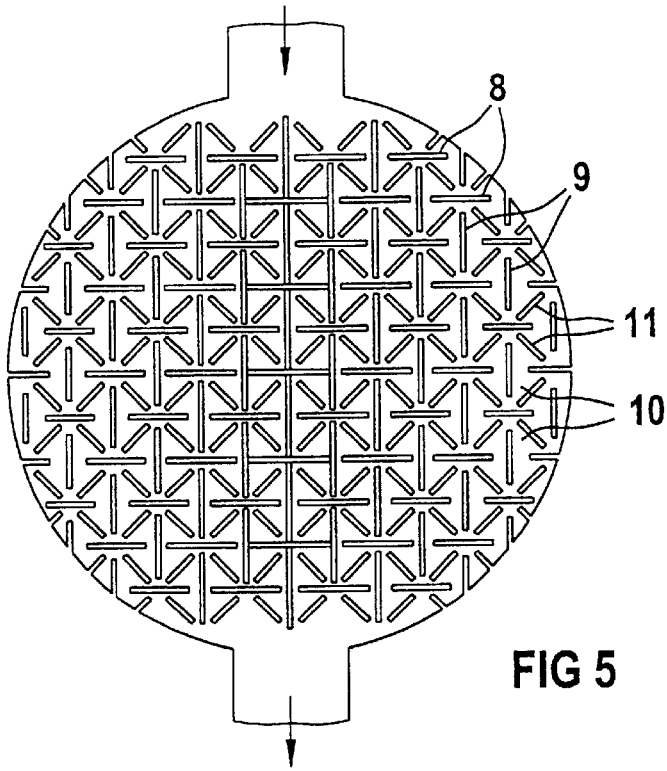
FIG. 5 shows a further variant of an emitter with a rectangular pattern of cuts.

FIG. 5 shows a variant in which additional diagonal cuts 11 are introduced in the cells 10 formed by the vertical and horizontal slots 8 and 9, (seen in the plane of the drawing). An even more homogenous current distribution can be achieved with the aid of these diagonal cuts.

Figure 6:
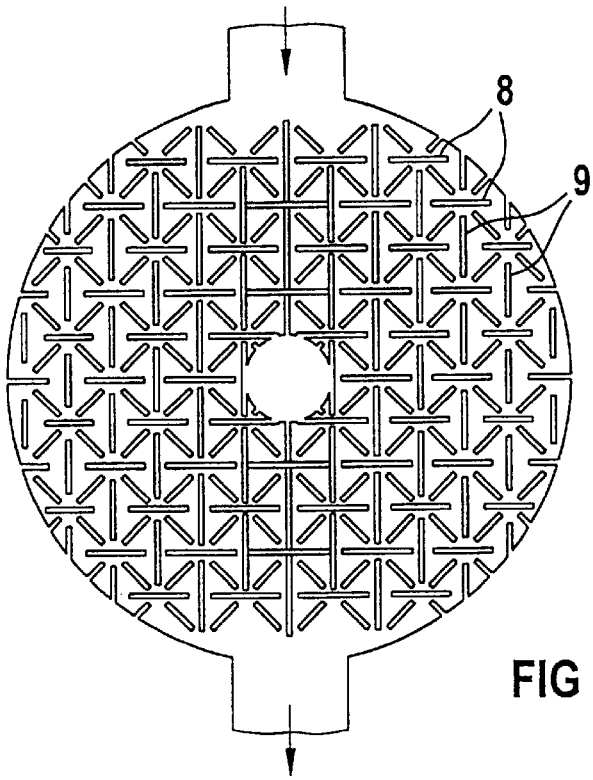
FIG. 6 shows a state of an emitter according to FIG. 5 after ions being welded on centrally.

FIG. 6 shows the emitter according to FIG. 5, in the state after ionic bombardment as described at the beginning. It can be seen that the grid structure is damaged only at the center, but this is not significant with reference to the flow of current, that is to say the emitter continues to function even despite this damage and does not need to be replaced. It can be advantageous to provide an appropriate cut-out for the free passage of ions at the center of the emitter directly, in order to prevent attack by ion bombardment.

Although the variants shown are based on a four-fold symmetry of a rectangular grating, it is possible to design the structure of cuts in a different way, for example, on the basis of a hexagonal cell structure.

List of Reference Symbols

1=Emitting surface
2=Emitter legs
3=Slots
4=Current paths
5=Emitter legs
6=Emitter legs
7=Emitting surface
8=Slots
9=Slots
10=Cells
11=Diagonal cuts (g)=Grating constant
(L)=Cut length
(n)=Ratio of half cut length to grating constant

What is claimed is:

1. A directly heated thermionic flat emitter whose emitting surface (1) has conductor tracks which are formed by slots in the emitting surface, and are supported by emitter legs (2; 5, 6) which form current conductors, the conductor tracks being formed by a grid pattern of cuts composed of a multiplicity of straight slots (3; 8, 9) which run at least transverse to a course of a main current direction and are arranged in a plurality of rows offset from one another in such a way as to produce a plurality of meandering current paths (4).

2. The directly heated thermionic flat emitter as claimed in claim 1, in which the pattern of cuts forms a multiplicity of parallel, meandering current paths (4).

3. The directly heated thermionic flat emitter as claimed in claim 1, in which the grid pattern of cuts has grating grid structure with slots (8, 9) running transverse to and along the main current direction.

4. The directly heated thermionic flat emitter as claimed in claim 3, in which the pattern of cuts has a rectangular structure of cuts.

5. The directly heated thermionic flat emitter as claimed in claim 1, in which the pattern of cuts has a grating constant (g) in the region of 0.1 mm to 1 mm in conjunction with a diameter of the emitter of approximately 5 mm, and the ratio of the half cut length (L) to the grating constant (g) is in the region of 0.3 to 0.8.

6. The directly heated thermionic flat emitter as claimed in claim 5, in which the ratio of the half cut length (L) to the grating constant (g) is designed in a decreasing fashion from the middle toward the edge in the case of the slots (8) transverse to the main current direction.

7. The directly heated thermionic flat emitter as claimed in claim 4, in which additional diagonal slots (11) are present in the cells (10) formed by the rectangular structure of cuts.

8. The directly heated thermionic flat emitter as claimed in claim 1, in which four emitter legs (5, 6) are provided for conducting current.

9. The directly heated thermionic flat emitter as claimed in claim 1, in which a cutout for the free passage of ions is provided in the center of the emitting surface (1).

10. The directly heated thermionic flat emitter as claimed in claim 1, wherein said grid pattern is a grating pattern composed of straight slots running transverse to said course of said main current direction and straight slots running along said course of said main current direction.

11. The emitter of claim 1, wherein the course of the main current direction is from one emitter leg to another emitter leg.

* * * * *